US010414015B2

(12) United States Patent
Fukushima et al.

(10) Patent No.: US 10,414,015 B2
(45) Date of Patent: Sep. 17, 2019

(54) POLISHING APPARATUS AND POLISHING METHOD

(71) Applicant: Ebara Corporation, Tokyo (JP)

(72) Inventors: Makoto Fukushima, Tokyo (JP); Hozumi Yasuda, Tokyo (JP); Shingo Togashi, Tokyo (JP)

(73) Assignee: Ebara Corporation, Tokyo (JP)

( * ) Notice: Subject to any disclaimer, the term of this patent is extended or adjusted under 35 U.S.C. 154(b) by 245 days.

(21) Appl. No.: 15/248,112

(22) Filed: Aug. 26, 2016

(65) Prior Publication Data

US 2017/0057049 A1 Mar. 2, 2017

(30) Foreign Application Priority Data

Sep. 2, 2015 (JP) ..... 2015-172679

(51) Int. Cl.
*B24B 37/005* (2012.01)

(52) U.S. Cl.
CPC ..... *B24B 37/005* (2013.01)

(58) Field of Classification Search
CPC ..... B24B 37/30; B24B 37/32; B24B 37/042; B24B 37/10; B24B 37/005; B24B 37/04; B24B 37/107
USPC ..... 451/288, 289, 287, 388, 398, 5, 6, 7, 8
See application file for complete search history.

(56) References Cited

U.S. PATENT DOCUMENTS 9,381,614 B2 7/2016 Takahashi et al.
2005/0054266 A1* 3/2005 Togawa ..... B24B 37/30 451/5
2005/0107015 A1* 5/2005 Togawa ..... B24B 37/30 451/285
2007/0243795 A1 10/2007 Kobayashi et al.
2008/0188162 A1* 8/2008 Kobata ..... B23H 5/08 451/8
2011/0159783 A1 6/2011 Fukushima et al.

FOREIGN PATENT DOCUMENTS

JP 2007-088041 A 4/2007
JP 2008-137103 A 6/2008
JP 2013-111679 A 6/2013

* cited by examiner

*Primary Examiner* — Monica S Carter
*Assistant Examiner* — Lauren M Beronja
(74) *Attorney, Agent, or Firm* — Abelman, Frayne & Schwab

(57) ABSTRACT

A polishing apparatus includes a polishing table for supporting a polishing pad and a substrate holding device for pressing a substrate against the polishing pad. The substrate holding device includes an elastic film to form multiple pressure chambers to press the substrate, and a pressure control unit controlling pressure of the pressure chambers. The pressure control unit includes a first flow path connected to a first pressure chamber, and first and second pressure regulation mechanisms. The pressure control unit performs switching control from first pressure regulation mechanism to second pressure regulation mechanism when a set pressure within first pressure chamber reaches a first threshold value. Then, the pressure control unit performs switching control from second pressure regulation mechanism to first pressure regulation mechanism when the set pressure within the first pressure chamber reaches a second threshold value lower than the first threshold value.

11 Claims, 7 Drawing Sheets

POLISHING APPARATUS AND POLISHING METHOD

CROSS-REFERENCE TO RELATED APPLICATIONS

This application is based on and claims priority from Japanese Patent Application No. 2015-172679, filed on Sep. 2, 2015, with the Japan Patent Office, the disclosure of which is incorporated herein in its entirety by reference.

TECHNICAL FIELD

The present disclosure relates to a polishing apparatus and method for polishing a substrate such as a wafer while holding the substrate.

BACKGROUND

According to high integration and high densification of semiconductor devices, circuit wirings are microfabricated more and more, and the number of layers of multi-layered wirings is also increased. When it is intended to implement a multi-layered wiring while achieving microfabrication of a circuit, a step is increased following the surface unevenness of an underlayer. Thus, as the number of wiring layers is increased, a film coatability for a step shape (step coverage) is deteriorated in forming a thin film. Accordingly, a flattening of a semiconductor device surface becomes increasingly important in a semiconductor device manufacturing process.

Chemical mechanical polishing (CMP) is an important technique for flattening a semiconductor device surface. In CMP, the surface of a wafer is polished by bringing the surface of the wafer held by a substrate holding device called a top ring or a polishing head into a sliding contact with a polishing surface of a polishing pad and relatively moving the polishing table and the substrate holding device in relation to each other, while a polishing liquid containing abrasive grains of, for example, silica ($SiO_2$) is supplied to the polishing surface of the polishing pad.

Here, when a relative pressing force between the wafer in the process of polishing and the polishing surface of the polishing pad is not uniform over the entire surface of the wafer, insufficient polishing or excessive polishing is caused depending on the pressing force imparted to the respective portions of the wafer. Thus, in order to uniformize the pressing force to the wafer, a pressure chamber formed by an elastic film is provided on the lower portion of the substrate holding device and a fluid such as, for example, air is supplied to the pressure chamber such that the wafer is pressed by the fluid pressure via the elastic film.

In manufacturing semiconductor devices, a polishing profile of a wafer edge has a significant influence on the yield of products. Thus, it is important to precisely adjust the polishing profile of the wafer edge. However, because the polishing pad is elastic, the pressing force applied to the edge (peripheral edge) of the wafer in the process of polishing becomes non-uniform, which may cause a so-called "edge drop" where an edge portion of the wafer is excessively polished.

Thus, for example, in a substrate holding device disclosed in Japanese Patent Laid-Open Publication No. 2013-111679, the elastic film is formed to have a flat region and a standing region positioned around the outer circumference of the flat region to be rising upwardly and vertically so that the pressing force to the substrate opposed to the standing region is locally reduced.

SUMMARY

An aspect of the present disclosure is related to a polishing apparatus that includes a polishing table for supporting a polishing pad and a substrate holding device for pressing a substrate against the polishing pad. The substrate holding device includes an elastic film configured to form a plurality of pressure chambers to press the substrate, a head body to which the elastic film is attached, a retainer ring disposed to surround the substrate, and a pressure control unit configured to control the pressure of the plurality of pressure chambers. The pressure control unit includes a first flow path connected to a first pressure chamber which is one of the plurality of pressure chambers, and a first pressure regulation mechanism and a second pressure regulation mechanism that are provided, in parallel with each other, in the first flow path. The pressure control unit is configured to control the pressure of the first pressure chamber by performing a switching between the first pressure regulation mechanism and the second pressure regulation mechanism.

The foregoing summary is illustrative only and is not intended to be in any way limiting. In addition to the illustrative aspects, embodiments, and the features described above, further aspects, embodiments, and features will become apparent by reference to the drawings and the following detailed description.

DETAILED DESCRIPTION

Figure 1:
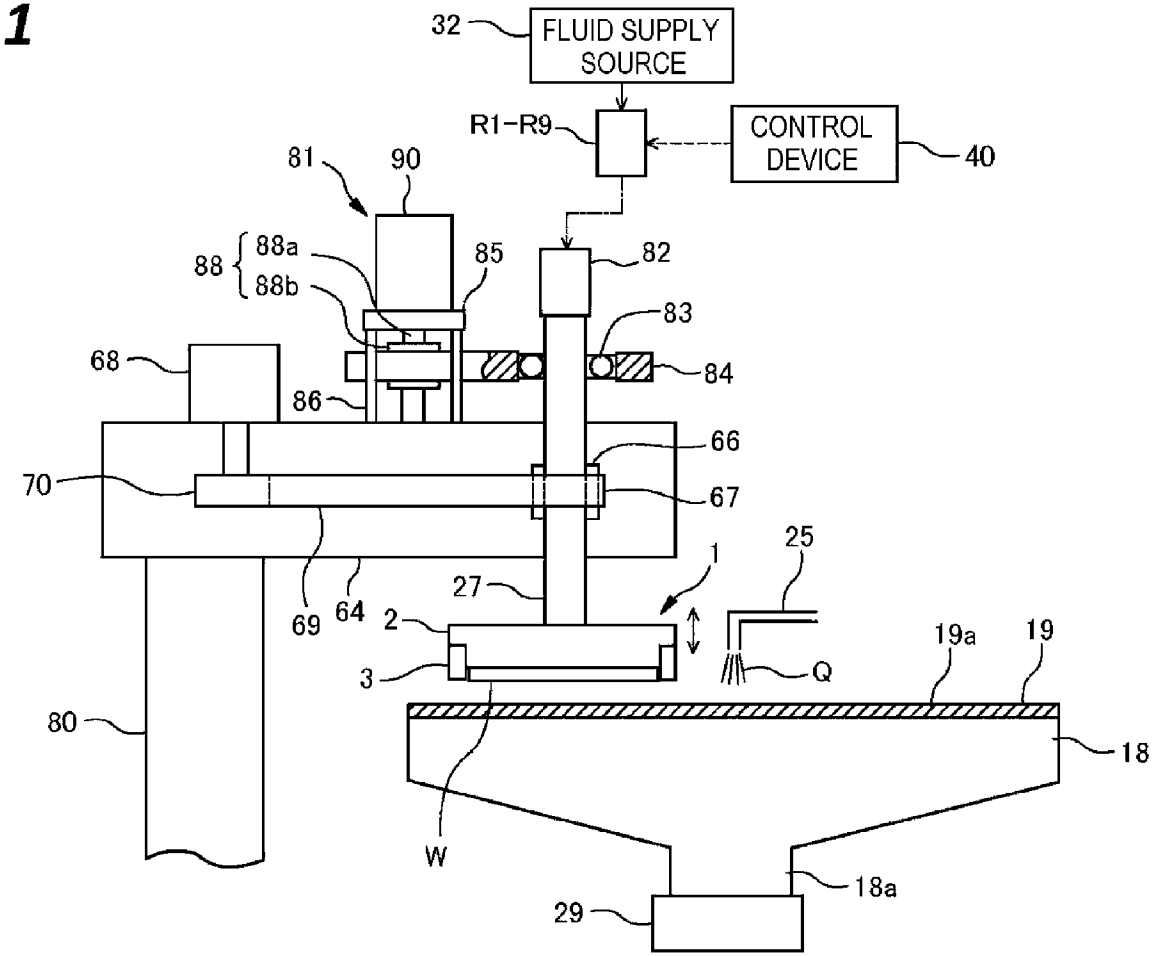
FIG. 1 is a view illustrating an exemplary embodiment of a polishing apparatus.

In the following detailed description, reference will be made to the accompanying drawings, which form a part hereof. The exemplary embodiments described in the detailed description, drawings, and claims are not meant to be in any way limiting. Other embodiments may be utilized, and other changes may be made without departing from the spirit or scope of the subject matter presented here.

Recently, from the viewpoint of responding to polishing various devices as well as enhancing a throughput by increasing the polishing speed, what is requested is a polishing apparatus that is available in a wide range of pressure. At the same time, in order to improve the performance of polishing a distal end device, high precision of polishing pressure during a low pressure polishing is increasingly needed, and in particular, high precision at the wafer edge is strongly requested.

In order to enable polishing in a wide range of pressure, it is necessary to use a pressure controller that has a large full scale (FS) range. However, because the precision of the pressure controller is generally proportional to the full scale, a ratio occupied by error with respect to a used pressure range (low pressure) is increased when the pressure controller having a large full scale range is used in the low pressure polishing. As a result, it becomes difficult to perform the polishing with high precision in the low pressure polishing.

Thus, the present disclosure is to provide a polishing apparatus and method that are capable of performing a polishing with high precision in the low pressure polishing as well as enabling a polishing in a wide range of pressure.

An aspect of the present disclosure is a polishing apparatus that includes a polishing table configured to support a polishing pad thereon and a substrate holding device configured to press a substrate against the polishing pad. The substrate holding device includes an elastic film configured to form a plurality of pressure chambers to press the substrate, a head body to which the elastic film is attached, a retainer ring disposed to surround the substrate, and a pressure control unit configured to control the pressure of the plurality of pressure chambers. The pressure control unit includes a first flow path connected to a first pressure chamber which is one of the plurality of pressure chambers, and a first pressure regulation mechanism and a second pressure regulation mechanism that are provided, in parallel with each other, in the first flow path. The pressure control unit is configured to control the pressure of the first pressure chamber by performing a switching between the first pressure regulation mechanism and the second pressure regulation mechanism.

Each of the first pressure regulation mechanism and the second pressure regulation mechanism may include a pressure controller configured to regulate the pressure within the first pressure chamber, and a pressure control range of the pressure controller of the first pressure regulation mechanism may be set to be smaller than a pressure control range of the pressure controller of the second pressure regulation mechanism.

Here, when the set pressure within the first pressure chamber reaches a first threshold value, the pressure control unit may perform a switching from the first pressure regulation mechanism to the second pressure regulation mechanism, and when the set pressure within the first pressure chamber reaches at a second threshold value that is lower than the first threshold value, the pressure control unit may perform a switching from the second pressure regulation mechanism to the first pressure regulation mechanism.

In addition, the pressure control unit may include a second flow path connected to a second pressure chamber which is one of the plurality of pressure chambers, and a third pressure regulation mechanism and a fourth pressure regulation mechanism that are provided, in parallel with each other, in the second flow path. The pressure control unit may be configured to control the pressure of the second pressure chamber by performing a switching between the first pressure regulation mechanism and the second pressure regulation mechanism. In addition, the first pressure chamber and the second pressure chamber may be located adjacent to each other.

In an aspect of the present disclosure, the elastic film includes a side wall vertically standing up from a peripheral edge of a substrate holding surface that is abutted on the substrate, and a first peripheral wall connected to the side wall. And, the first pressure chamber is formed by the side wall, the first peripheral wall, and the head body.

Another aspect of the present disclosure is a method of polishing a substrate by pressing the substrate held by a substrate holding device against a polishing pad. The substrate holding device includes an elastic film configured to form a plurality of pressure chambers to press the substrate, and a pressure control unit configured to control the pressure of the plurality of pressure chambers. The pressure control unit is configured to control the pressure of a first pressure chamber, which is one of the plurality of pressure chambers, by performing a switching between a first pressure regulation mechanism and a second pressure regulation mechanism which are connected to the first pressure chamber in parallel with each other.

According to the present disclosure, substrate polishing with high precision is enabled while the pressure range is widely maintained by providing a first pressure regulation mechanism and a second pressure regulation mechanism in parallel to each other with respect to one pressure chamber, and using the first and second pressure regulation mechanisms in a switching manner. In addition, by providing two threshold values of pressure for switching the operations of pressure controllers provided in the two pressure regulation mechanisms, the pressure controllers may not be switched even in a case where a set pressure fluctuates up and down in the vicinity of the threshold values, so that a stable pressure control is enabled.

Hereinafter, an exemplary embodiment of the present disclosure will be described with reference to the accompanying drawings. FIG. 1 is a view illustrating an exemplary embodiment of a polishing apparatus. The polishing apparatus includes a polishing table 18 configured to support a polishing pad 19 and a polishing head (a substrate holding device) 1 configured to hold a wafer W as an example of a substrate which is an object to be polished, and press the wafer W against the polishing pad 19 on the polishing table 18.

The polishing table 18 is connected, through a table shaft 18*a*, to a table motor 29 disposed below the polishing table 18 and is configured to be rotatable around the table shaft 18*a*. The polishing pad 19 is attached to the top surface of the polishing table 18, and the surface 19*a* of the polishing pad 19 forms a polishing surface that polishes the wafer W. A polishing liquid supply nozzle 25 is provided above the polishing table 18, and a polishing liquid Q is supplied onto the polishing pad 19 on the polishing table 18 by the polishing liquid supply nozzle 25.

The polishing head 1 includes a head body 2 configured to press the wafer W against the polishing surface 19*a* and a retainer ring 3 configured to hold the wafer W such that the wafer W does not protrude from the polishing head 1. The polishing head 1 is connected to a head shaft 27, and the head shaft 27 is configured to be vertically movable with respect to a head arm 64 by a vertical movement mechanism 81. The entire polishing head 1 is lifted to be positioned with respect to the head arm 64 by the vertical movement of the head shaft 27. A rotary joint 82 is attached to the upper end of the head shaft 27.

The vertical movement mechanism 81 configured to vertically move the head shaft 27 and the polishing head 1 includes a bridge 84 configured to rotatably support the head shaft 27 via a bearing 83, a ball screw 88 attached to the bridge 84, a support 85 supported by a column 86, and a servo motor 90 provided on the support 85. The support 85 configured to support the servo motor 90 is fixed to the head arm 64 via the column 86.

The ball screw 88 includes a screw shaft 88*a* connected to the servo motor 90 and a nut 88*b* screw-coupled to the screw shaft 88*a*. The head shaft 27 is configured to vertically move integrally with the bridge 84. Accordingly, when the servo motor 90 is driven, the bridge 84 moves vertically via the ball screw 88, which causes the head shaft 27 and the polishing head 1 to move vertically.

The head shaft 27 is connected to a rotary cylinder 66 via a key (not illustrated). The rotary cylinder 66 includes a timing pulley 67 on the outer periphery thereof. A head motor 68 is fixed to the head arm 64, and the timing pulley 67 is connected to a timing pulley 70 provided on the head motor 68 via a timing belt 69. Accordingly, when the head motor 68 is rotationally driven, the rotary cylinder 66 and the head shaft 27 are integrally rotated via the timing pulley 70, the timing belt 69, and the timing pulley 67 so that the polishing head 1 is rotated. The head arm 64 is supported by an arm shaft 80 that is rotatably supported on a frame (not illustrated). The polishing apparatus includes a control device 40 configured to control respective devices within the apparatus including the head motor 68 and the servo motor 90.

The polishing head 1 is configured to hold the wafer W on the bottom surface thereof. The head arm 64 is configured to be pivotable about the arm shaft 80, and the polishing head 1, which holds the wafer W on the bottom surface thereof, moves from a wafer W reception position to a position above the polishing table 18 by the pivoting of the head arm 64.

The polishing of the wafer W is performed as follows. The polishing head 1 and the polishing table 18 are individually rotated, and the polishing liquid Q is supplied onto the polishing pad 19 from the polishing liquid supply nozzle 25 provided above the polishing table 18. In this state, the polishing head 1 is lowered to a predetermined position (predetermined height), and the wafer W is pressed against the polishing surface 19*a* of the polishing pad 19 at the predetermined position. The wafer W is in a sliding contact with the polishing surface 19*a* of the polishing pad 19 causing the surface of the wafer W to be polished.

Figure 2:
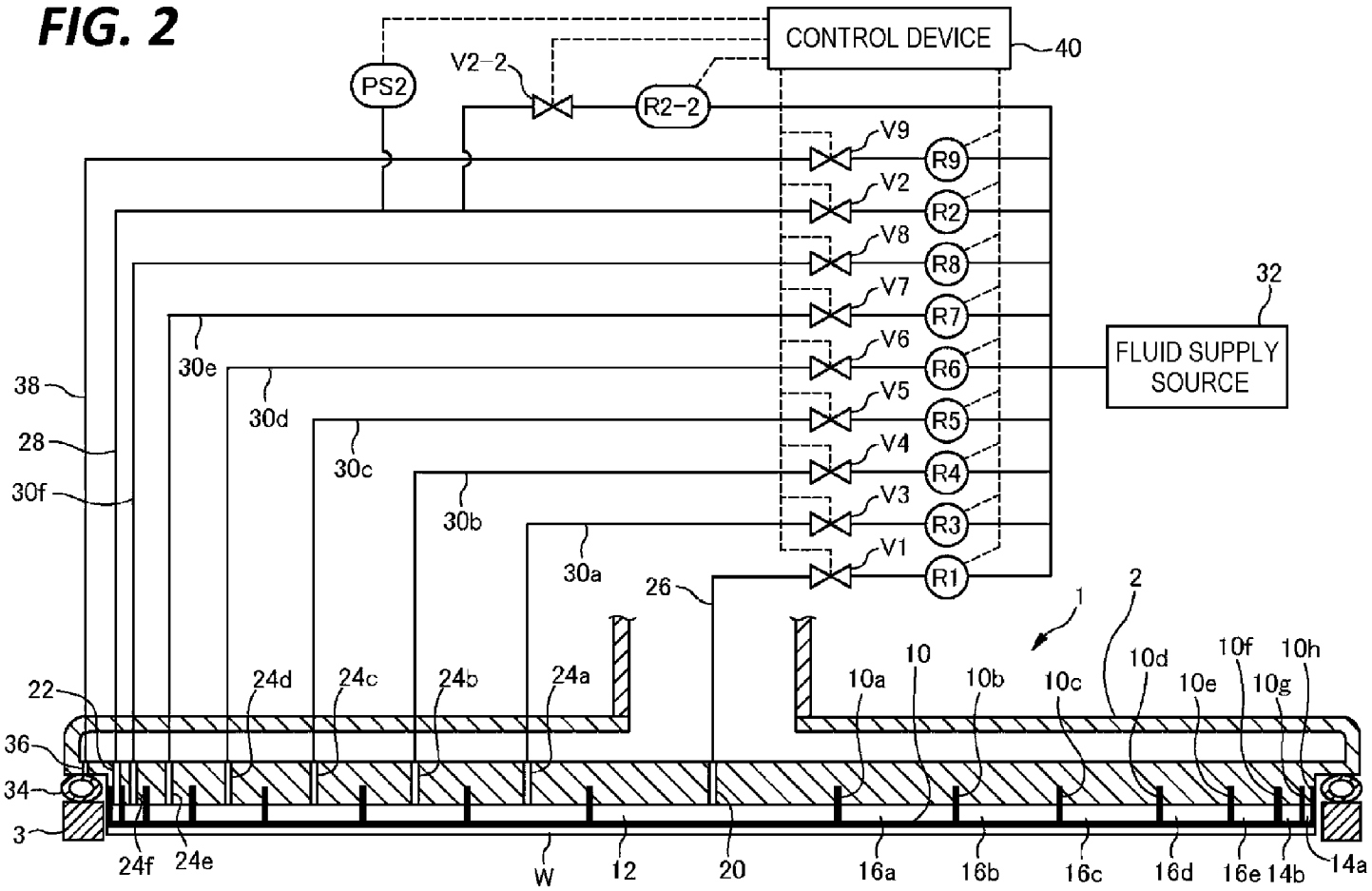
FIG. 2 is a view illustrating a polishing head (substrate holding device) that is provided in the polishing apparatus illustrated in FIG. 1.

Next, the polishing head (substrate holding device) 1 provided in the polishing apparatus illustrated in FIG. 1 will be described in detail with reference to FIG. 2. As illustrated in FIG. 2, the polishing head 1 includes the head body 2 fixed to the lower end of the head shaft 27, the retainer ring 3 configured to directly press the polishing surface 19*a*, and a flexible elastic film 10 configured to press the wafer W against the polishing surface 19*a*. The retainer ring 3 is disposed to surround the wafer W and connected to the head body 2. The elastic film 10 is attached to the head body 2 to cover the bottom surface of the head body 2.

The head body 2 is formed of a resin (e.g., an engineering plastic (e.g., PEEK)), and the elastic film 10 is formed of a rubber material excellent in strength and endurance (e.g., ethylene propylene rubber (EPDM), polyurethane rubber, or silicon rubber.

The elastic film 10 is provided with a plurality of (in the drawing, eight (8)) concentrically arranged annular peripheral walls 10*a*, 10*b*, 10*c*, 10*d*, 10*e*, 10*f*, 10*g*, 10*h*. By the plurality of peripheral walls 10*a* to 10*h*, a circular central pressure chamber 12 positioned at the center, annular edge pressure chambers 14*a*, 14*b* positioned at the outermost periphery, and five (5) annular intermediate pressure chambers (first to fifth intermediate pressure chambers) 16*a*, 16*b*, 16*c*, 16*d*, 16*e* positioned between the central pressure chamber 12 and the edge pressure chambers 14*a*, 14*b* are formed between the top surface of the elastic film 10 and the bottom surface of the head body 2.

Each of a flow path 20 communicating with the central pressure chamber 12, a flow path 22 communicating with the edge pressure chamber 14*a*, a flow path 24*f* communicating with the edge pressure chamber 14*b*, and flow paths 24*a*, 24*b*, 24*c*, 24*d*, 24*e* respectively communicating with the intermediate pressure chambers 16*a*, 16*b*, 16*c*, 16*d*, 16*e* is formed within the head body 2. In addition, the flow paths 20, 22, 24*a* to 24*f* are connected to a fluid supply source 32 through fluid lines 26, 28, 30*a*, 30*b*, 30*c*, 30*d*, 30*e*, 30*f*, respectively. The fluid lines 26, 28, 30*a* to 30*f* are provided with opening/closing valves V1, V2, V3, V4, V5, V6, V7, V8, and pressure controllers R1, R2, R3, R4, R5, R6, R7, R8, respectively.

In addition, an opening/closing valve V2-2 and a pressure controller R2-2 are connected to the fluid line 28 connected to the flow path 22 corresponding to the edge pressure chamber 14*a*. The opening/closing valve V2-2 and the pressure controller R2-2 are connected to the fluid supply source 32 to be parallel with the opening/closing valve V2 and the pressure controller R2 of another set. In addition, a pressure sensor PS2 is connected to the fluid line 28 to measure the pressure of a fluid flowing in the fluid line 28.

A retainer chamber 34 is formed just above the retainer ring 3, and connected to the fluid supply source 32 via a flow path 36 formed within the head body 2 and a fluid line 38 provided with an opening/closing valve V9 and a pressure controller R9. Each of the pressure controllers R1 to R9, R2-2 has a pressure control function of controlling the pressure of a hydraulic fluid supplied to the pressure chambers 12, 14*a*, 14*b*, 16*a* to 16*e* and the retainer chamber 34 from the fluid supply source 32. The pressure controllers R1 to R9, R2-2 and the opening/closing valves V1 to V9, V2-2 are connected to the control device 40 such that the operations of the pressure controllers and the opening/closing valves are controlled by the control device 40.

Of the two pressure controllers R2, R2-2 connected to the fluid line 28 corresponding to the above-mentioned edge pressure chamber 14*a*, one pressure controller R2 (hereinafter, referred to as a "first pressure controller") has a full scale (control range) of, for example, 500 hPa, and is used during a low pressure polishing that polishes the wafer edge at a relatively low pressure. In addition, the other pressure controller R2-2 (hereinafter, referred to as a "second pressure controller") has a full scale larger than that of the first pressure controller (e.g., 1000 hPa), and is used during a high pressure polishing that polishes the wafer edge at a relatively high pressure.

A pressure control error caused by a pressure controller relies on the full scale, and is influenced by an error in linearity, hysteresis, repeatability, resolution, or the like, as well. The pressure control error is generally about 1% or 2% of the full scale. Thus, the pressure control by the first pressure controller having a small full scale may be performed with high precision compared to the pressure control by the second pressure controller.

The combination of the full scales of the first and second pressure controllers is not limited to the above-mentioned one, and may be properly determined according to, for example, the usage or precision of the polishing apparatus. As the combination of the full scales of the first and second pressure controllers, for example, a combination of 250 hPA and 500 hPa or a combination of 250 hPa and 1000 hPa may be adopted.

According to the polishing head 1 configured as illustrated in FIG. 2, the pressure of the hydraulic fluid supplied to each of the pressure chambers 12, 14*a*, 14*b*, 16*a* to 16*e* is controlled in a state where the wafer W is held on the polishing head 1 such that plural regions on the elastic film 10 along the radial direction of the wafer W may press the wafer W with different pressures, respectively. In this way, in the polishing head 1, the pressing force applied to the wafer W may be adjusted at respective regions of the wafer W by controlling the pressure of the fluid supplied to each of the pressure chambers 12, 14*a*, 14*b*, 16*a* to 16*e* that are formed between the head body 2 and the elastic film 10. At the same time, the pressing force of the retainer ring 3 pressing the polishing pad 19 may be adjusted by controlling the pressure of the hydraulic fluid supplied to the retainer chamber 34.

Figure 3:
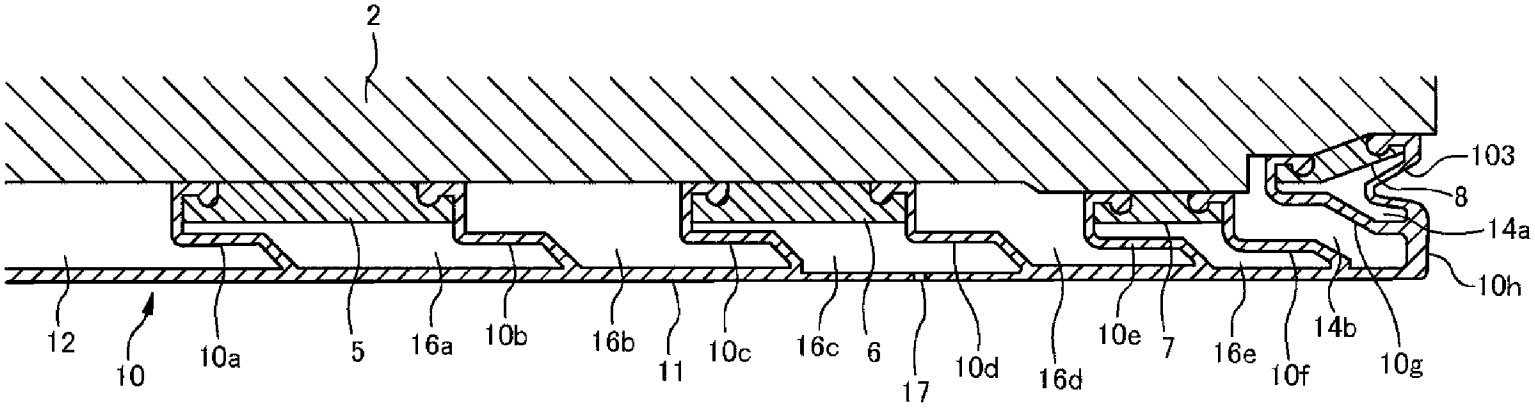
FIG. 3 is a sectional view illustrating an elastic film (membrane) provided on the polishing head illustrated in FIG. 2.

As illustrated in FIG. 3, the elastic film 10 includes a circular contact portion 11 configured to be in contact with a wafer W, and eight (8) peripheral walls 10*a* to 10*h* directly or indirectly connected to the contact portion 11. The contact portion 11 is abutted on the rear surface of the wafer W (i.e., the surface opposite to the surface to be polished) so as to press the wafer W against the polishing pad 19. The peripheral walls 10*a* to 10*h* are concentrically arranged annular peripheral walls.

The upper ends of the peripheral walls 10*a* to 10*h* are attached to the bottom surface of the head body 2 by four (4) retaining rings 5, 6, 7, 8. The retaining rings 5 to 8 are detachably fixed to the head body 2 by a retaining part such as, for example, a screw (not illustrated).

The contact portion 11 has a plurality of through holes 17 communicating with the intermediate pressure chamber 16*c*. For the convenience, only one through hole 17 is illustrated in FIG. 3. When a vacuum is formed in the intermediate pressure chamber 16*c* in the state where the wafer W is abutted on the contact portion 11, the wafer W is retained on the bottom surface of the contact portion 11 (i.e., on the polishing head 1) by vacuum suction. In addition, when a pressurized fluid is supplied to the intermediate pressure chamber 16*c* in a state where the wafer W is separated from the polishing pad 19, the wafer W is released from the polishing head 1. The through hole 17 may be formed in another pressure chamber instead of the intermediate pressure chamber 16*c*. In such a case, the vacuum suction or release of the wafer W is performed by controlling the pressure of the pressure chamber where the through hole 17 is formed.

The peripheral wall 10*h* is the outermost peripheral wall, and the peripheral wall 10*g* is disposed radially inside the peripheral wall 10*h*. In addition, the peripheral wall 10*f* is disposed radially inside the peripheral wall 10*g*. Hereinafter, the peripheral wall 10*h* will be referred to as a first edge peripheral wall, the peripheral wall 10*g* will be referred to as a second edge peripheral wall, and the peripheral wall 10*f* will be referred to as a third edge peripheral wall.

Figure 4:
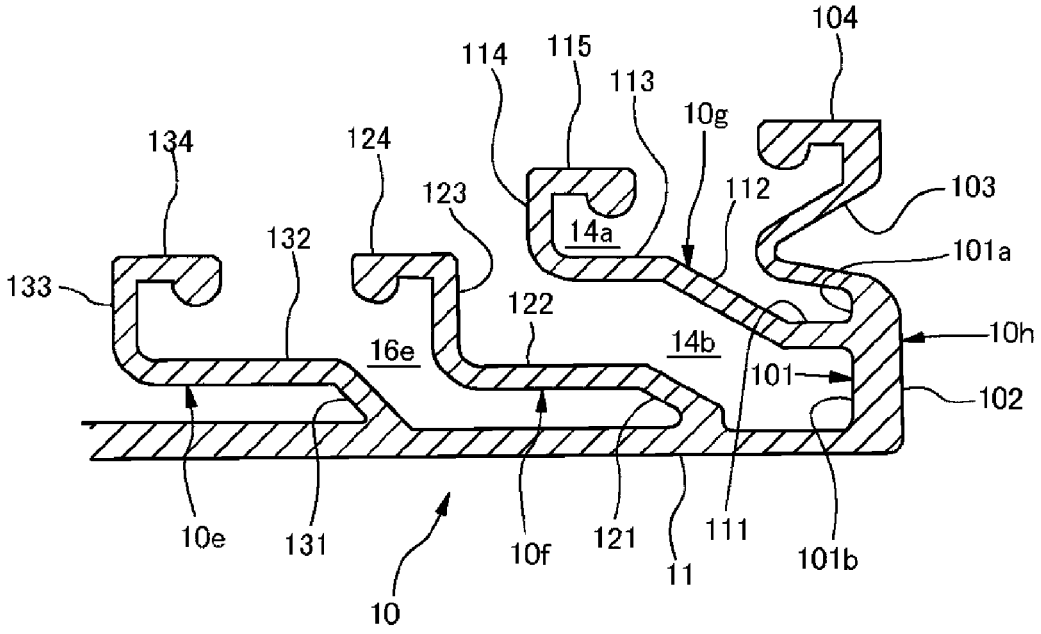
FIG. 4 is an enlarged sectional view illustrating a portion of the elastic film.

FIG. 4 is an enlarged sectional view illustrating a portion of the elastic film 10. The first edge peripheral wall 10*h* extends upwardly from the peripheral edge of the contact portion 11, and the second edge peripheral wall 10*g* is connected to the first edge peripheral wall 10*h*.

The second edge peripheral wall 10*g* has an outer horizontal portion 111 connected to an inner peripheral surface 101 of the first edge peripheral wall 10*h*. The inner peripheral surface 101 of the first edge peripheral wall 10*h* has an upper inner peripheral surface 101*a* and a lower inner peripheral surface 101*b* which extend vertically with respect to the contact portion 11. The upper inner peripheral surface 101*a* extends upwardly from the outer horizontal portion 111 of the second edge peripheral wall 10*g*, and the lower inner peripheral surface 101*b* extends downwardly from the outer horizontal portion 111 of the second edge peripheral wall 10*g*. In other words, the outer horizontal portion 111 of the second edge peripheral wall 10*g* is connected to a position that divides the inner peripheral surface 101 extending vertically with respect to the contact portion 11. The lower inner peripheral surface 101*b* is connected to the peripheral edge of the contact portion 11, and the outer peripheral wall 102 positioned outside extends vertically with respect to the contact portion 11. The upper inner peripheral surface 101*a* and the lower inner peripheral surface 101*b* are positioned in the same plane (e.g., an imaginary plane vertical to the contact portion 11). That is, the radial positions of the upper inner peripheral surface 101*a* and the lower inner peripheral surface 101*b* are the same.

The first edge peripheral wall 10*h* has a bent portion 103 that allows the vertical movement of the contact portion 11. The bent portion 103 is connected to the upper inner peripheral surface 101*a*. The bent portion 103 has a bellows structure configured to be extendable in a direction perpendicular to the contact portion 11 (i.e., in the vertical direction). Accordingly, even if the distance between the head body 2 and the polishing pad 19 is changed, the contact between the peripheral edge of the contact portion 11 and the wafer W may be maintained.

The second edge peripheral wall 10*g* has an outer horizontal portion 111 extending horizontally from the inner peripheral surface 101 of the first edge peripheral wall 10*h*. In addition, the second edge peripheral wall 10*g* includes an inclined portion 112 connected to the outer horizontal portion 111, an inner horizontal portion 113 connected to the inclined portion 112, a vertical portion 114 connected to the inner horizontal portion 113, and a rim portion 115 connected to the vertical portion 114. The inclined portion 112 is inclined upwardly while extending radially and inwardly from the outer horizontal portion 111. The rim portion 115 extends radially and outwardly from the vertical portion 114, and is fixed to the bottom surface of the head body 2 by the retaining ring 8 illustrated in FIG. 3. When the first edge peripheral wall 10*h* and the second edge peripheral wall 10*g* are attached to the bottom surface of the head body 2 by the retaining ring 8, the edge pressure chamber 14*a* is formed between the first edge peripheral wall 10*h* and the second edge peripheral wall 10*g*.

The third edge peripheral wall 10*f* is disposed radially inside the second edge peripheral wall 10*g*. The third edge peripheral wall 10*f* includes an inclined portion 121 connected to the top surface of the contact portion 11, a horizontal portion 122 connected to the inclined portion 121, a vertical portion 123 connected to the horizontal portion 122, and a rim portion 124 connected to the vertical portion 123. The inclined portion 121 is inclined upwardly while extending radially and inwardly from the top surface of the contact portion 11. The rim portion 124 extends radially and inwardly from the vertical portion 123, and is fixed to the bottom surface of the head body 2 by the retaining ring 7 illustrated in FIG. 3. When the second edge peripheral wall 10*g* and the third edge peripheral wall 10*f* are attached to the bottom surface of the head body 2 by the retaining rings 8, 7, respectively, the edge pressure chamber 14*b* is formed between the second edge peripheral wall 10*g* and the third edge peripheral wall 10*f*.

The peripheral wall 10*e* is disposed radially inside the third edge peripheral wall 10*f*. The peripheral wall 10*e* includes an inclined portion 131 connected to the top surface of the contact portion 11, a horizontal portion 132 connected to the inclined portion 131, a vertical portion 133 connected to the horizontal portion 132, and a rim portion 134 connected to the vertical portion 133. The inclined portion 131 is inclined upwardly while extending radially and inwardly from the top surface of the contact portion 11. The rim portion 134 extends radially and outwardly from the vertical portion 133, and is fixed to the bottom surface of the head body 2 by the retaining ring 7 illustrated in FIG. 3. When the peripheral wall 10*e* and the third edge peripheral wall 10*f* are attached to the bottom surface of the head body 2 by the retaining ring 7, the intermediate pressure chamber 16*e* is formed between the peripheral wall 10*e* and the third edge peripheral wall 10*f*.

Since the peripheral walls 10*b*, 10*d* illustrated in FIG. 3 have substantially the same configuration as the third edge peripheral wall 10*f* illustrated in FIG. 4, and the peripheral walls 10*a*, 10*c* illustrated in FIG. 3 have substantially the same configuration as the peripheral wall 10*e* illustrated in FIG. 4, descriptions thereof will be omitted. As illustrated in FIG. 3, the rim portions of the peripheral walls 10*a*, 10*b* are fixed to the bottom surface of the head body 2 by the retaining ring 5, and the rim portions of the peripheral walls 10*c*, 10*d* are fixed to the bottom surface of the head body 2 by the retaining ring 6.

As illustrated in FIG. 4, the edge pressure chamber 14*a* is disposed above the edge pressure chamber 14*b* and is partitioned by the second edge peripheral wall 10*g* that extends substantially horizontally. The second edge peripheral wall 10*g* is connected to the first edge peripheral wall 10*h*. Thus, when the pressure of the edge pressure chamber 14*a* is higher than the pressure of the edge pressure chamber 14*b*, the differential pressure between the edge pressure chamber 14*a* and the edge pressure chamber 14*b* generates a downward force that vertically presses down the first edge peripheral wall 10*h*. As a result, the peripheral edge of the contact portion 11 presses the wafer edge against the polishing pad 19. In this way, since the downward force vertically acts on the first edge peripheral wall 10*h* itself, the peripheral edge of the contact portion 11 may press the narrow region of the wafer edge against the polishing pad 19 such that the polishing profile of the wafer edge may be precisely controlled. On the contrary, when the pressure of the edge pressure chamber 14*a* is lower than the pressure of the edge pressure chamber 14*b*, the differential pressure between the edge pressure chamber 14*a* and the edge pressure chamber 14*b* generates an upward force that vertically pushes up the first edge peripheral wall 10*h*. As a result, the pressing force applied by the peripheral edge of the contact portion 11 to press the wafer edge against the polishing pad 19 is reduced. In this way, since the upward force vertically acts on the first edge peripheral wall 10*h* itself, the peripheral edge of the contact portion 11 may reduce the pressing force applied by the narrow region of the wafer edge against the polishing pad 19 such that the polishing profile of the wafer edge may be precisely controlled.

The upper inner peripheral surface 101*a* extends vertically and upwardly with respect to the contact portion 11, and the lower inner peripheral surface 101*b* extends vertically and downwardly with respect to the contact portion 11. By such shapes of the upper inner peripheral surface 101*a* and the lower inner peripheral surface 101*b*, no force acts on the connection portion between the first edge peripheral wall 10*h* and the second edge peripheral wall 10*g* in an inclined direction such that a polishing rate may be controlled in the narrow region of the wafer edge.

As described above, in the polishing apparatus according to the present exemplary embodiment, the first pressure controller R2 for a low pressure polishing and the second pressure controller R2-2 for a high pressure polishing are connected, in parallel with each other, to the fluid line 28 corresponding to the edge pressure chamber 14*a*, and any one of the first pressure controller R2 and the second pressure controller R2-2 may be selectively used by controlling the opening/closing of the corresponding opening/closing valves V2, V2-2.

For example, when it is intended to perform polishing in the state where the edge pressure chamber 14*a* is set to a relatively low pressure, the valve V2 is opened by operating the first pressure controller R2 in a state where the valve V2-2 connected to the second pressure controller R2-2 is closed. By this, the pressure of the edge pressure chamber 14*a* may be controlled by the first pressure controller R2 with a small full scale (FS) (i.e., with a small error) with high precision such that precise polishing may be performed.

Meanwhile, when it is intended to perform polishing in the state where the edge pressure chamber 14*a* is set to a relatively high pressure, the valve V2-2 is opened by operating the second pressure controller R2-2 in a state where the valve V2 connected to the first pressure controller R2 is closed. As a result, polishing may be performed in a state where the pressure of the edge pressure chamber 14*a* is maintained at a relatively high pressure by the second pressure controller R2-2 that has a large full scale (FS). In this way, a pressure controller to be used may be properly selected and used based on a polishing recipe set in advance.

In addition, during the polishing of a substrate, the polishing may be performed while switching the pressure controllers being used depending on the pressure within the edge pressure chamber 14*a*. For example, during the low pressure polishing, the first pressure controller R2 is operated, and at the same time, the valve V2 is opened and the valve V2-2 is closed. In this state, the pressure within the edge pressure chamber 14*a* is increased, and at the time point when the pressure exceeds a predetermined value, the operation of the first pressure controller R2 is stopped and the second pressure controller is operated. At the same time, the valve V2 is closed and the valve V2-2 is opened. As a result, a highly precise polishing is enabled while a wide range of pressure is maintained.

Here, when the switching of pressure controllers and the switching of valves are simultaneously performed, the pressure within a line just after the switching may be dropped by the influence of, for example, the pressure rising speed of the second pressure controller R2-2 operated by the switching. In order to avoid this phenomenon, the second pressure controller R2-2 is operated in advance prior to switching the opened/closed valves, thereby pressurizing the line to a portion just before the inlet side of the valve V2-2 to a set pressure. Then, when the valve V2-2 is opened and the valve V2 is closed, the discontinuous change of pressure during the valve switching may be reduced.

In the polishing apparatus in the present exemplary embodiment, it is possible to perform an in-situ closed loop control (CLC) in which information such as, for example, a film thickness of a substrate in the process of polishing, is monitored by a sensor not illustrated and embedded in the polishing table (e.g., an eddy current sensor or an optical sensor) and a polishing pressure is changed based on the monitored result. In a case where the substrate polishing is performed by the in-situ CLC, the pressure of the edge pressure chamber 14*a*, which is needed during the polishing, is changed every moment. When the pressure in the vicinity of a threshold value for switching the above-described two pressure controllers is to rise and fall, it is required to frequently switch the pressure controllers being used, which may make the pressing force unstable.

Figure 5:
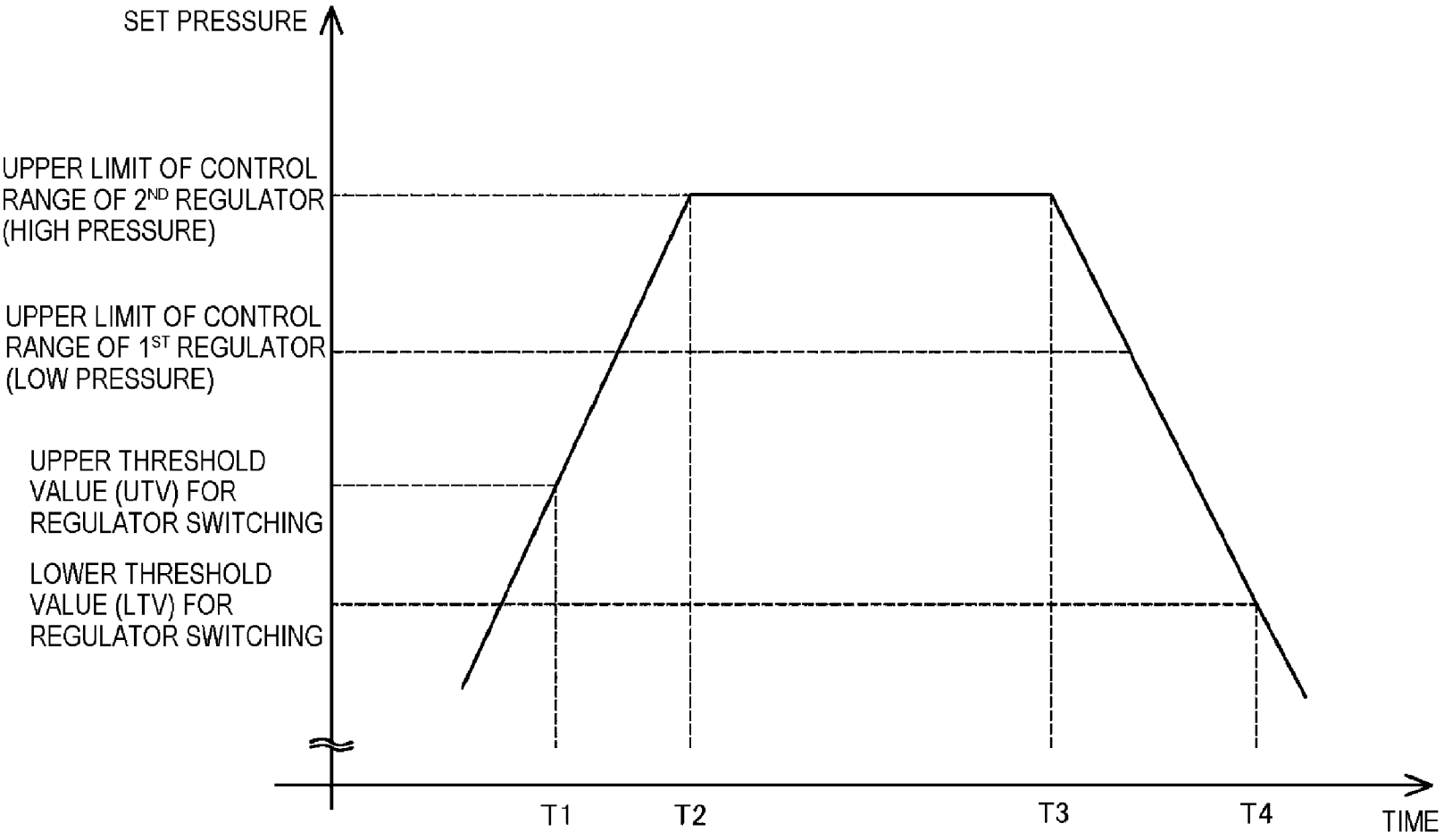
FIG. 5 is an explanatory view illustrating an example of a switching control of a first controller and a second controller.

For this reason, as illustrated in an example of FIG. 5, the pressure control may be performed by providing two threshold values for switching pressure controllers (e.g., an upper threshold value (UTV) and a lower threshold value (LTV)). In FIG. 5, the horizontal axis represents time, and the vertical axis represents a set pressure within the edge pressure chamber 14*a*. In addition, the upper limit of control range represents the full scale (FS) of a pressure controller.

In FIG. 5, when the set pressure of the edge pressure chamber 14*a* is low, the pressure control is performed using the first pressure controller R2. In addition, even after the set pressure of the edge pressure chamber 14*a* exceeds the LTV, the pressure control by the first pressure controller R2 is maintained, and at a time point when the set pressure of the edge pressure chamber 14*a* reaches the UTV (time T1), the pressure control is switched to a pressure control by the second pressure controller R2-2.

After the pressure control is switched to the pressure control by the second pressure controller R2-2 for a relatively high pressure, the set pressure within the edge pressure chamber 14*a* is increased to reach the upper limit of control range for the second pressure controller at time T2, and the substrate polishing is performed with the same set pressure until time T3. Then, the set pressure within the edge pressure chamber 14*a* is reduced. Even after the set pressure reaches the UTV, the pressure control by the second pressure controller R2-2 is continued, and at a time point when the set pressure within the edge pressure chamber 14*a* reaches the LTV (time T4), the pressure control is switched to a pressure control by the first pressure controller R2 for a relatively low pressure.

Here, the UTV and the LTV may be properly determined according to the purpose of polishing. However, the UTV may be determined in a range of 80% to 99%, in particular 90% to 99% of the control range upper limit of the first pressure controller R2. In addition, the premise is that the LTV is lower than the UTV. However, the LTV may be determined in a range of 50% to 95%, in particular 80% to 95% of the control range upper limit of the first pressure controller R2.

Figure 6:
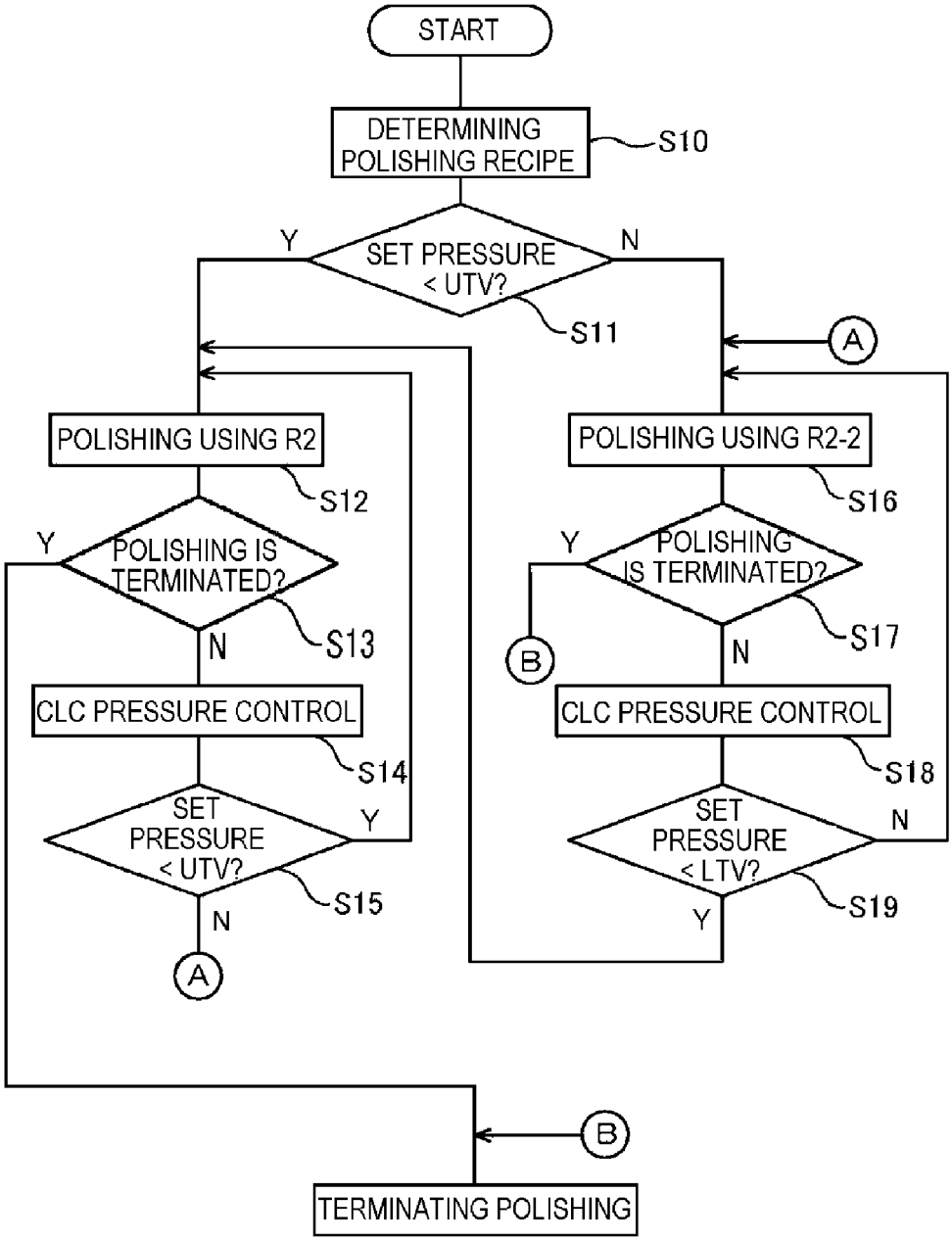
FIG. 6 is a flowchart illustrating an example of the switching control of the first controller and the second controller.

Hereinafter, an exemplary operation of the polishing apparatus according the above-described configuration will be described using the flowchart of FIG. 6. First, a polishing condition such as, for example, a polishing recipe used for polishing, a set pressure of the edge pressure chamber, or a final film thickness of a substrate is set (step S10), and substrate polishing is initiated.

At step S11, a determination is made as to whether the set pressure of the edge pressure chamber is smaller than the UTV, and when it is determined that the set pressure is smaller than the UTV, the operation proceeds to step S12 at which polishing is performed using the pressure controller R2 for a relatively low pressure. At step S13, a determination is made as to whether the polishing is terminated, and when it is determined that the polishing is not terminated, the pressure value within the edge pressure chamber is set by the above-mentioned in-situ CLC control (step S14). In the determination as to whether the polishing is terminated, various determination requirements such as, for example, whether a polishing time reaches a set time, whether the film thickness of the substrate reaches the final film thickness, and whether the driving current of the table motor 29 reaches a set value, are set.

Next, at step S15, a determination is made as to whether the set pressure of the edge pressure chamber is smaller than the UTV, and when it is determined that the set pressure is smaller than the UTV, the operation returns to step S12 at which a pressure control by the pressure controller R2 for a relatively low pressure is continuously performed.

Meanwhile, when the set pressure is larger than the UTV, the pressure controller is switched to the pressure controller R2-2 for a relatively high pressure and polishing is performed. At step S17, a determination is made as to whether the polishing is terminated, and when it is determined that the polishing is not terminated, the pressure value within the edge pressure chamber is set by the above-mentioned in-situ CLC control (step S18).

In addition, at step S19, a determination is made as to whether the set pressure of the edge pressure chamber is smaller than the LTV, and when it is determined that the set pressure is larger than the LTV, the operation returns to step S16 at which a pressure control by the pressure controller R2-2 for a relatively high pressure is continuously performed. Meanwhile, when it is determined that the set pressure is smaller than the LTV, the pressure controller is switched to the pressure controller R2 for a relatively low pressure and polishing is performed.

At steps S13 and S17, when it is determined that the polishing is terminated, the polishing is terminated.

When the pressure controller for a relatively low pressure which is capable of performing a pressure control with high precision and the pressure controller for a relatively high pressure which has a large full scale are used in combination as described above, substrate polishing with high precision is enabled while maintaining the pressure range widely. In addition, when two threshold values of pressure for switching the operations of two kinds of pressure controllers are provided, the pressure controllers are not switched even in a case where a set pressure fluctuates up and down in the vicinity of the threshold values, so that a stable pressure control is enabled.

Next, a configuration of a polishing apparatus according to a separate exemplary embodiment of the present disclosure will be described with reference to FIG. 7. In addition, the same members as those of the polishing apparatus of the preceding exemplary embodiment will be denoted by the same reference numerals and detailed descriptions thereof will be omitted.

Figure 7:
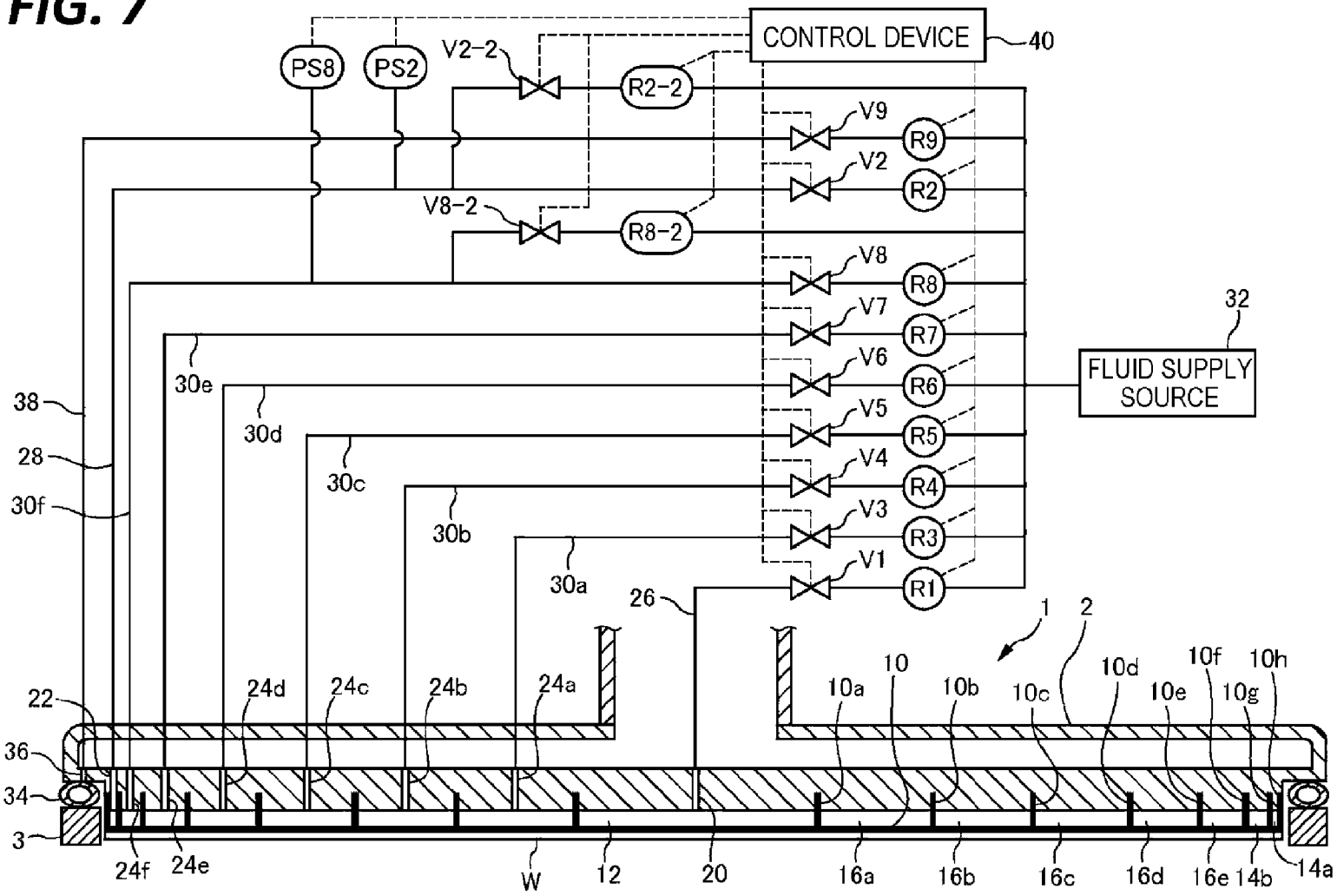
FIG. 7 is a view illustrating a separate exemplary embodiment of a polishing apparatus.

The polishing apparatus illustrated in FIG. 7 is different from the example of FIG. 2 in that the fluid line 30*f* corresponding to the edge pressure chamber 14*b* provided under the edge pressure chamber 14*a* includes an opening/closing valve V8-2 and a pressure controller R8-2 which are provided to be parallel with an opening/closing valve V8 and a pressure controller R8 of another set. The pressure controller R8-2 is connected to a fluid supply source 32. In addition, a pressure sensor PS8 is connected to the fluid line 30*f* to measure the pressure of a fluid flowing in the fluid line 30*f*.

The pressure controller R8-2 has a pressure control function of controlling the pressure of a hydraulic fluid supplied to the pressure chamber 14*b* from the fluid supply source 32. In addition, the pressure controller R8-2 and the opening/closing valve V8-2 are connected to the control device 40 such that the operations thereof are controlled.

As in the above-described exemplary embodiment, of the two pressure controllers R8 and R8-2 connected to the fluid line 30*f* in parallel with each other, the full scale (control range) of one pressure controller R8 is set to be smaller than the full scale of the other pressure controller R8-2. When the pressure controller for a relatively low pressure which is capable of performing a pressure control with high precision and the pressure controller for a relatively high pressure which has a large full scale are used in combination, substrate polishing with high precision is enabled while maintaining the pressure range widely.

As described above with reference to FIG. 4, a downward force of vertically pressing down the first edge peripheral wall 10*h* or an upward force of vertically pushing up the first edge peripheral wall 10*h* is generated by a differential pressure between the upper edge pressure chamber 14*a* and the lower edge pressure chamber 14*b*. In the polishing apparatus according to the present exemplary embodiment, because it is possible to precisely control not only the pressure of the upper edge pressure chamber 14*a* but also the pressure of the lower edge pressure chamber 14*b*, substrate polishing with higher precision is enabled.

In the polishing apparatus according to the present exemplary embodiment, a pressure control is performed by performing a switching between the pressure controller for a relatively low pressure and the pressure controller for a relatively high pressure. However, in a case where a precise pressure control is not required (e.g., a water-polishing process intended for, for example, cleaning of a wafer which is performed after slurry-polishing), it is not necessary to perform a switching control of pressure controllers. Accordingly, substrate polishing may be performed using only the pressure controller for a relatively high pressure which has a large full scale.

In the above-described exemplary embodiment, a pressure control is performed by performing a switching between a plurality of pressure controllers connected to a fluid line corresponding to the edge pressure chamber. However, the same pressure control may be performed for another pressure chamber. In addition, in the above-described exemplary embodiment, a pressure control is performed for one or two pressure chambers using a plurality of pressure controllers. However, the same pressure control may be performed for three or more pressure chambers. In the case where a pressure control is performed for a plurality of pressure chambers using a plurality of pressure controllers, a plurality of adjacent pressure chambers may be the target for the pressure control.

In the exemplary embodiment, two pressure controllers are connected to an edge pressure chamber. However, three or more pressure controllers may be connected in parallel with each other.

In the above-described exemplary embodiment, a switching control of pressure controllers is performed based on the set pressure of the edge pressure chamber. However, the switching control of pressure controllers may be performed based on a pressure value measured by the pressure sensors PS2, PS8.

From the foregoing, it will be appreciated that various exemplary embodiments of the present disclosure have been described herein for the purpose of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A polishing apparatus comprising:

a polishing table configured to support a polishing pad;

a substrate holding device configured to press a substrate against the polishing pad and including an elastic film configured to form a plurality of pressure chambers to press the substrate, a head body to which the elastic film is attached, and a retainer ring disposed to surround the substrate; and a pressure control unit configured to control a pressure of the plurality of pressure chambers, wherein the pressure control unit includes a first flow path connected to a first pressure chamber which is one of the plurality of pressure chambers, and includes a first pressure regulation mechanism and a second pressure regulation mechanism that are connected, in parallel with each other, to the first flow path, the pressure control unit being configured to control the pressure of the first pressure chamber by performing switching between the first pressure regulation mechanism and the second pressure regulation mechanism.

2. The polishing apparatus of claim 1, wherein each of the first pressure regulation mechanism and the second pressure regulation mechanism includes a pressure controller configured to regulate the pressure within the first pressure chamber, and a pressure control range of the pressure controller of the first pressure regulation mechanism is smaller than a pressure control range of the pressure controller of the second pressure regulation mechanism.

3. The polishing apparatus of claim 2, wherein, when a set pressure within the first pressure chamber reaches a first threshold value, the pressure control unit performs a switching from the first pressure regulation mechanism to the second pressure regulation mechanism, and when the set pressure within the first pressure chamber reaches a second threshold value that is lower than the first threshold value, the pressure control unit performs a switching from the second pressure regulation mechanism to the first pressure regulation mechanism.

4. The polishing apparatus of claim 1, wherein the pressure control unit includes a second flow path connected to a second pressure chamber which is one of the plurality of pressure chambers, and a third pressure regulation mechanism and a fourth pressure regulation mechanism that are connected to the second flow path in parallel with each other, and the pressure control unit is configured to control the pressure of the second pressure chamber by performing a switching between the third pressure regulation mechanism and the fourth pressure regulation mechanism.

5. The polishing apparatus of claim 4, wherein the first pressure chamber and the second pressure chamber are located adjacent to each other.

6. The polishing apparatus of claim 1, wherein the elastic film includes a side wall vertically standing up from a peripheral edge of a substrate holding surface that is abutted on the substrate and a first peripheral wall connected to the side wall, and the first pressure chamber is formed by the side wall, the first peripheral wall and the head body.

7. The polishing apparatus of claim 1, wherein the elastic film includes a side wall vertically standing up from a peripheral edge of a substrate holding surface that is abutted on the substrate, a first peripheral wall connected to the side wall, and a second peripheral wall connected to the substrate holding surface inside the first peripheral wall, and the first pressure chamber is formed by the first peripheral wall, the second peripheral wall, and the head body.

8. A method of polishing a substrate, the method comprising:

providing the substrate holding device including an elastic film configured to form a plurality of pressure chambers to press a substrate, and a pressure control unit configured to control a pressure of the plurality of pressure chambers, wherein the substrate is held by the substrate holding device and pressed against a polishing pad, thereby being polished; and controlling, by the pressure control unit, a pressure of a first pressure chamber which is one of the plurality of pressure chambers by performing switching between a first pressure regulation mechanism and a second pressure regulation mechanism which are connected to the first pressure chamber in parallel with each other through a first flow path.

9. The method of claim 8, wherein the controlling, by the pressure control unit, the pressure of the first chamber includes:

performing, when a set pressure within the first pressure chamber reaches a first threshold value, a switching from the first pressure regulation mechanism to the second pressure regulation mechanism, and performing, when the set pressure within the first pressure chamber reaches a second threshold value that is lower than the first threshold value, a switching from the second pressure regulation mechanism to the first pressure regulation mechanism.

10. The polishing apparatus of claim 1, wherein the first pressure regulation mechanism and the second pressure regulation mechanism are respectively used for different pressure control ranges.

11. The method of claim 8, wherein the first pressure regulation mechanism and the second pressure regulation mechanism are respectively used for different pressure control ranges.

* * * * *